US007178467B2

(12) United States Patent
Le Bellec et al.

(10) Patent No.: US 7,178,467 B2
(45) Date of Patent: Feb. 20, 2007

(54) DOOR THRESHOLD FOR ACCESS TO THE INTERIOR OF A RAILWAY VEHICLE

(75) Inventors: Jean-Luc Le Bellec, La Rochelle (FR); Christophe Gomis, Nieul sur Mer (FR)

(73) Assignee: Alstom Transport SA, Levallois-Perret (FR)

( * ) Notice: Subject to any disclaimer, the term of this patent is extended or adjusted under 35 U.S.C. 154(b) by 0 days.

(21) Appl. No.: 11/047,649

(22) Filed: Feb. 2, 2005

(65) Prior Publication Data

US 2005/0217533 A1 Oct. 6, 2005

(30) Foreign Application Priority Data

Apr. 2, 2004 (FR) ..... 04 01079

(51) Int. Cl.
*B61C 17/04* (2006.01)

(52) U.S. Cl. ..... 105/458

(58) Field of Classification Search ..... 105/425–427, 105/432, 436, 439, 440, 458
See application file for complete search history.

(56) References Cited

U.S. PATENT DOCUMENTS 2,951,454 A * 9/1960 Candlin, Jr. ..... 105/447
5,357,869 A * 10/1994 Barjolle et al. ..... 105/436
5,775,232 A * 7/1998 Golemis et al. ..... 105/458
6,167,816 B1 * 1/2001 Lavery et al. ..... 105/458
2003/0006575 A1 1/2003 Genis et al.

FOREIGN PATENT DOCUMENTS

DE 23 08 006 8/1974
DE 37 10 317 10/1988

* cited by examiner

*Primary Examiner*—S. Joseph Morano
*Assistant Examiner*—Robert J. McCarry, Jr.
(74) *Attorney, Agent, or Firm*—Sughrue Mion, PLLC

(57) ABSTRACT

The door threshold for a railway vehicle is intended to partially fill the gap between the vehicle and a platform. It comprises a support (22) which can be connected to the structure (16) of the railway vehicle and a strip (24) which is retained by the support (22). The strip (24) can be displaced between a normal position, in which it projects relative to the support (22), and a position retracted in the support (22). It comprises means (30A, 30B) for clamping the strip against at least a clamping surface (30A, 30B) of the support in order to produce friction of a specific value between the strip (24) and the support (22) counter to the displacement of the strip (24) relative to the support (22) in the plane of the or each clamping surface (30A, 30B).

15 Claims, 6 Drawing Sheets

DOOR THRESHOLD FOR ACCESS TO THE INTERIOR OF A RAILWAY VEHICLE

TECHNICAL FIELD

The present invention relates to a door threshold for access to the interior of a railway vehicle, which threshold is intended to partially fill the gap between the vehicle and a platform, comprising a support which can be connected to the structure of the railway vehicle and a strip which is retained by the support, which strip can be displaced between a normal position, in which it projects relative to the support, and a position retracted in the support.

BACKGROUND TO THE INVENTION

Railway vehicles for urban transport, such as tramway cars, stop along an elevated platform in order to allow passengers to enter and leave through lateral openings which are provided in the side of the vehicle and which are normally closed by doors.

A gap is provided between the side of the railway vehicle and the edge of the platform in order to allow the vehicle to move without colliding with the platform.

In order to prevent passengers who are entering or leaving the vehicle from falling or injuring themselves owing to the presence of this gap which they have to cross, it is known to provide for the openings for access to the vehicle to be equipped, in the lower portion thereof, with a door threshold which projects outwards relative to the side of the vehicle. This threshold fills, at least partially, the gap between the side of the vehicle and the platform at the location of the access opening, preventing passengers from injuring themselves.

Such a threshold also allows access to the vehicle for persons in wheelchairs or whose mobility is reduced, and ensures comfortable access for the other passengers.

These thresholds which project laterally out of the general space taken up by the vehicle can be caused, under some circumstances, to touch the edge of the platform.

Thus, there have been envisaged thresholds which can be deployed under the action of one or more actuators. These thresholds project relative to the side of the vehicle only when it is stopped along a platform. Conversely, the thresholds are retracted when the vehicle is moving. Such thresholds are very complex to produce and are therefore expensive.

Fixed thresholds which protrude permanently relative to the side of the vehicle have also been envisaged. In order to prevent these thresholds from touching the platform, they are arranged so as to be widely spaced from the edge of the platform so that a large gap still remains between the threshold and the platform. The problem of passenger safety is therefore overcome only in an incomplete manner.

So-called "breakable" thresholds have further been envisaged. These thresholds have elements for connection to the structure of the vehicle, which elements can break when the threshold comes into contact with the edge of the platform. The threshold, and in particular the connection means which it comprises, must be replaced after each breakage, which makes the cost of running the railway vehicle high.

Furthermore, these thresholds can be dangerous, after the connection elements have broken, because the threshold can then become completely or partially detached and injure a passer-by.

SUMMARY OF THE INVENTION

The object of the invention is to provide a door threshold which allows the gap between the vehicle and the platform to be effectively filled without the running cost of the railway vehicle being high and without any danger for passers-by.

To this end, the invention relates to a door threshold of the above-mentioned type, characterized in that it comprises means for clamping the strip against at least a clamping surface of the support in order to produce friction of a specific value between the strip and the support counter to the displacement of the strip relative to the support in the plane of the or each clamping surface.

According to specific embodiments, the door threshold comprises one or more of the following features:

- the clamping means are the only means for retaining the strip;
- the strip and the support comprise means for guiding the strip from the normal projecting position into the retracted position thereof, which means are provided at the ends of the strip;
- the strip is formed from a polymer material;
- the strip has at least a hooking profile for a traction tool allowing displacement of the strip from the retracted position to the normal projecting position thereof;
- it further comprises at least a stop for longitudinally arresting the strip, which stop is fixedly joined to one of the strip or the support and is received so as to slide in a slot which is provided in the other of the strip or the support, which slot extends in the direction of movement of the strip;
- the support delimits a cap for retaining the strip, which cap has two facing clamping surfaces, between which the strip is retained by a press-fit;
- the support comprises a metal profile-section having two arms, each of which has a clamping surface and delimits the cap for retaining the strip, the two arms being connected in the profile-section by a web, with which they are integrally formed;
- the cap delimits a free space for receiving the strip in the retracted position thereof;
- the clamping means comprise at least a tie rod which is fixedly joined to a first of the strip or the support, which tie rod is arranged so as to slide relative to the second of the strip or the support and is supported on the second of the strip or the support, the tie rod applying a force for clamping the strip against the clamping surface of the support;
- the tie rod comprises a clamping screw which can adjust the clamping force applied by the tie rod;
- one of the strip or the support comprises a T-shaped slot which is provided over the thickness thereof and the tie rod comprises a strip which is received in the slot; and
- the T-shaped slot is provided in the strip and opens at an end which is arranged at the side directed towards the retracted position of the strip.

BRIEF DESCRIPTION OF DRAWINGS

The invention will be better understood from a reading of the description below which is given purely by way of example and with reference to the drawings, in which.

DESCRIPTION OF PREFERRED EMBODIMENTS

Figure 1:
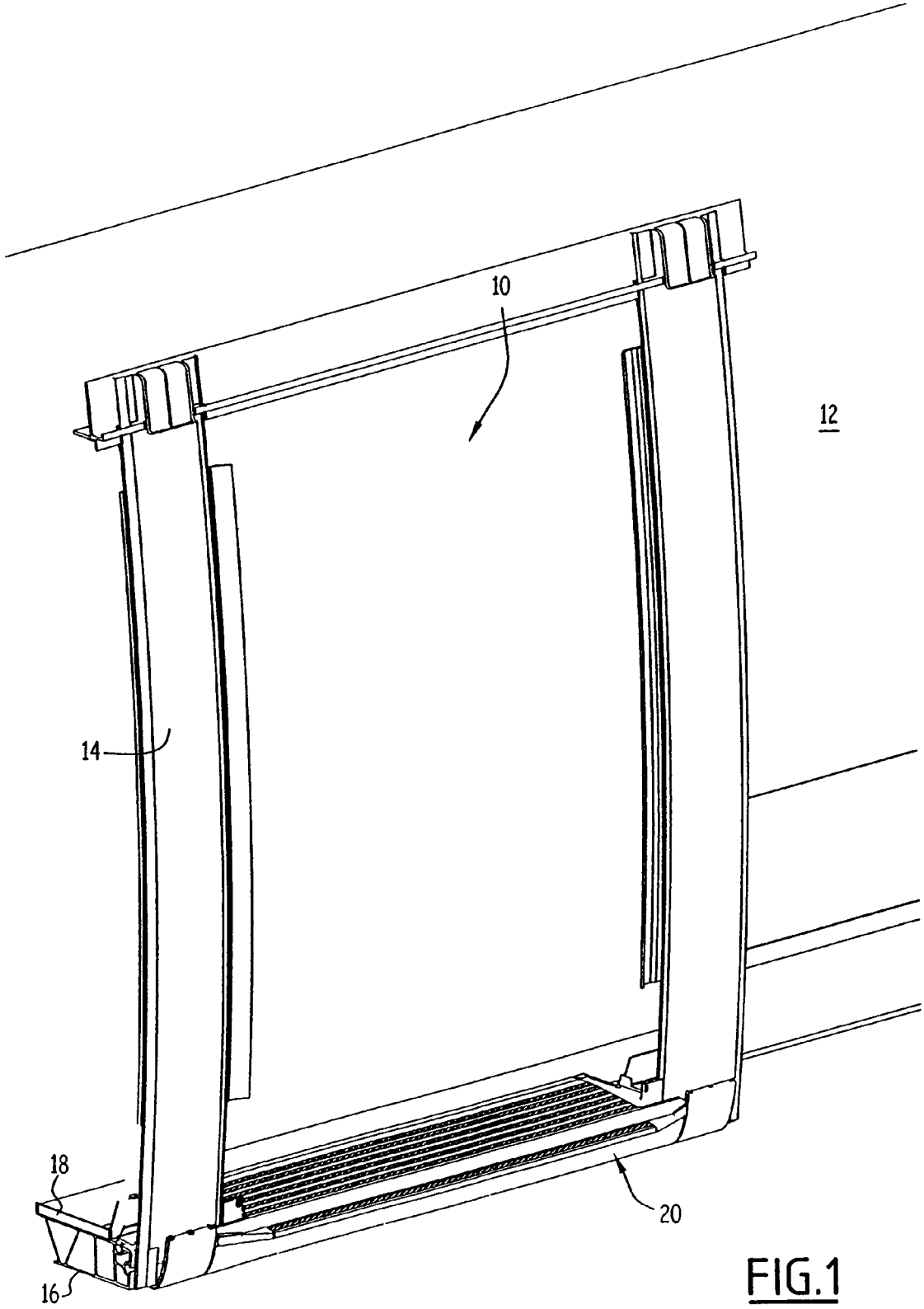
FIG. 1 is a perspective view of an opening for access to the interior of a railway vehicle.

As illustrated in FIG. 1 and as known per se, a railway vehicle, in particular a tramway car, comprises access openings 10 which are provided through the lateral side 12 thereof. These access openings are delimited by a generally rectangular door frame 14, relative to which two doors slide (not illustrated). The doors can be displaced between a position for closing the access opening and a retracted position which allows passage through the access opening.

At the lower end thereof, the railway vehicle comprises a longitudinal beam 16 which forms part of the rigid structure of the vehicle. In particular, this beam 16 supports the floor 18 which is formed, for example, by wood panels covered with a floor covering.

Furthermore, a door threshold which is generally designated 20 is fixedly joined to the structure of the vehicle and in particular to the beam 16 at the bottom of the access opening 10. This threshold normally protrudes outwards and is intended to fill the gap between the vehicle and a platform in order to allow passengers to enter and leave without any risk of falling.

Figure 2:
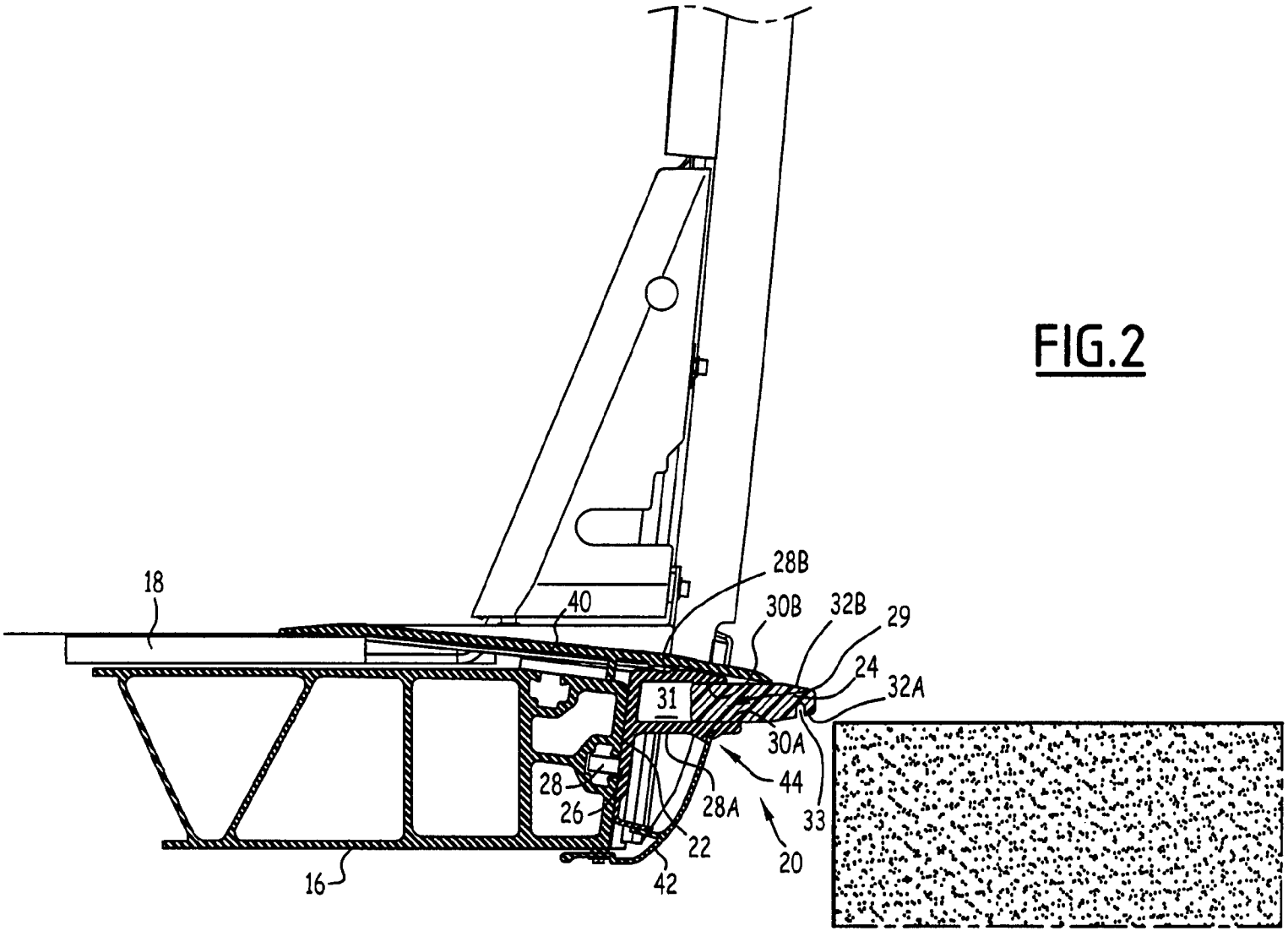
FIGS. 2 and 3 are cross-sections of the lower portion of a railway vehicle showing a first embodiment of a threshold according to the invention, the strip being in a normal projecting position and a retracted position, respectively.
Figure 3:
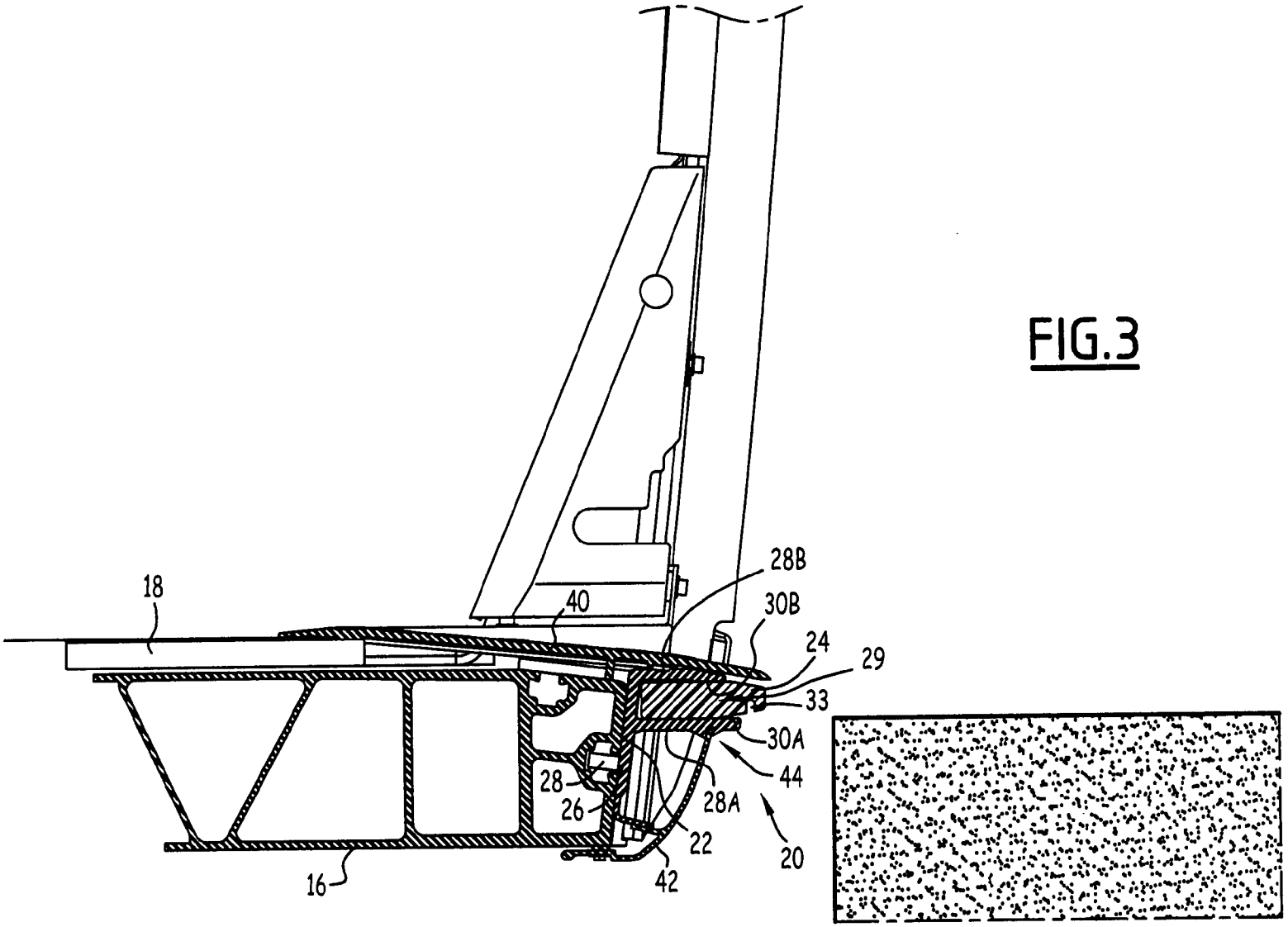

As illustrated in FIGS. 2 and 3, the threshold 20 comprises a support profile-section 22 which receives and retains in position a strip 24 which partially protrudes longitudinally outside the vehicle.

The profile-section 22 extends over the entire length of the opening 10. It comprises a web 26 which is pressed against the beam 16 and which is connected thereto by screws 28 which are distributed over the length of the profile-section.

Two arms 28A, 28B of the profile-section delimit a cap 29 for retaining the strip 24. They extend perpendicularly to the web 26 and are formed integrally therewith. Those two arms 28A, 28B extend over the entire length of the profile-section. They have, at the free ends thereof, two surfaces 30A, 30B for clamping the strip 24. Those surfaces extend parallel with each other and are capable of enclosing the strip 24 and retaining it by means of friction owing to a press-fit. In this manner, they form a means for clamping the strip against both of the two clamping surfaces 30A, 30B.

The strip 24 is constituted by a polymer profile-section having two main parallel faces which are pressed against the clamping surfaces 30A, 30B. This strip has a width of between 50 mm and 120 mm and, for example, in the order of 85 mm. The length thereof is substantially equal to the width of the opening 10, this length being, for example, two metres. Its thickness is in the order of between 1 cm and 5 cm and is, for example, in the order of 2 cm.

A free space 31 is reserved at the rear of the clamping surfaces 30A, 30B inside the cap between the web 26 and the strip 24. This reserved space 31 has a width of between 20 mm and 40 mm and is, for example, in the order of 30 mm.

The strip 24 has, at the ends and over the thickness thereof, oblong apertures which are arranged over the width of the strip. Guiding pins which are fixedly joined to the support profile-section 22 are engaged in those oblong apertures in order to bring about guiding of the strip between a normal projecting position, as illustrated in FIG. 2, and a retracted position, as illustrated in FIG. 3. The guiding is brought about in a direction parallel with the clamping surfaces 30A, 30B.

Other means for guiding the strip can be used, such as stops, at the two ends of the strip.

Along the edge referred to as the outer edge directed away from the vehicle, the strip 24 has chamfers 32A, 32B along the edges thereof.

Recesses 33 are provided at the lower face of the strip 24 with regular spacing over the length of the strip. They are positioned adjacent to the protruding edge of the strip 24. These recesses can receive a tool in order to displace the strip 24 relative to the support profile-section 22.

Initially, in its normal position, that is to say, before colliding with the edge of a platform, the strip 24 projects out of the cap 29 over more than half of the width thereof. In this manner, it is retained between the clamping surfaces 30A, 30B over only the rear portion thereof.

Furthermore, an access plate 40 is attached in the lower portion of the access opening 10 over the entire width thereof. This plate 40 covers the upper portion of the beam 16 and the support profile-section 22 and extends partially, at one end, over the floor 18 and, at the other end thereof, over the strip 24. Thus, the strip 24 projects relative to that access plate by a length of between 20 mm and 40 mm and preferably substantially in the order of 34 mm.

Finally, a cladding cover 42 is attached to the support profile-section 22 along the cap 29. The cover 42 is retained, at one end, in a slot 44 which is provided in an arm 28A of the cap and is fixed, at the other end thereof, by being bolted to the beam 16.

Initially, the strip 24 is as illustrated in FIG. 2. It is retained only by clamping between the two surfaces 30A, 30B. In this manner, when the vehicle is at the platform, the strip 24 fills the majority of the space between the platform and the vehicle, allowing safe and comfortable access to the interior of the vehicle. The press-fit which is brought about by the two parallel clamping surfaces is sized to retain the strip 24 during the movement of the train, in particular with regard to vibrations. This fit is also sized in order to prevent tilting of the strip under the action of the weight of a passenger who is resting on the edge of the strip and in order to withstand the impacts which can be imparted by passengers when the threshold is crossed.

On the other hand, the press-fit is sufficiently weak for the strip, if the strip collides with the platform when the vehicle is moving, to be partially retracted in the free space 31, as illustrated in FIG. 3.

After retraction, the strip 24 can be withdrawn manually by engaging a tool in the through-recesses 33 provided at the lower face of the strip and drawing the strip by means of this tool in order to bring it into the projecting position thereof, as illustrated in FIG. 2. The strip is again retained only between the two clamping surfaces 30A, 30B by the initial press-fit.

In this manner, it will be appreciated that the same strip can be displaced several times in the event of impacts against a platform and, on each occasion, re-positioned easily, the connection only by means of a press-fit preventing any disassembly and replacement of complex connection means.

Figure 4:
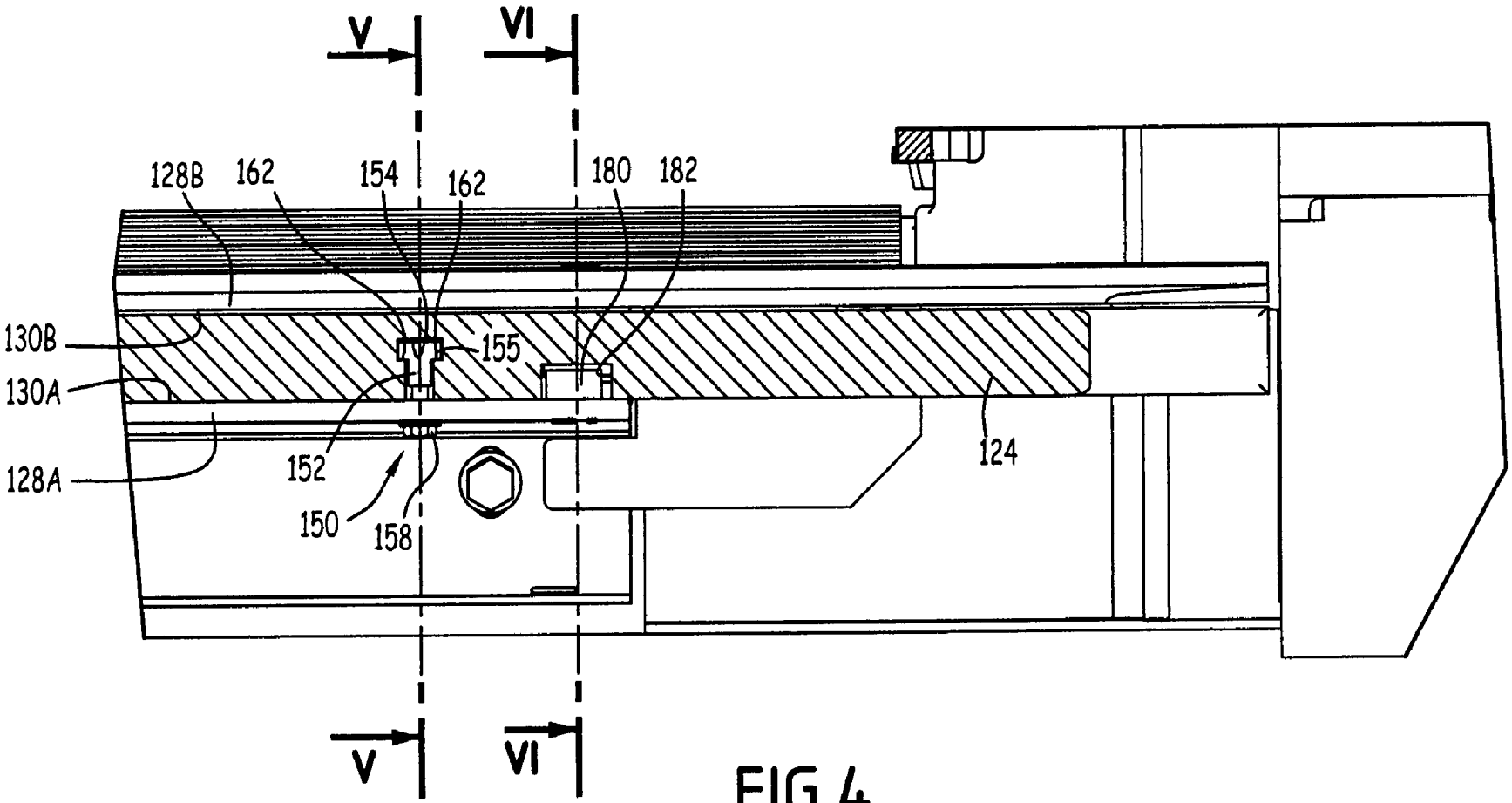
FIG. 4 is a longitudinal section of a second embodiment of a threshold according to the invention.
Figure 5:
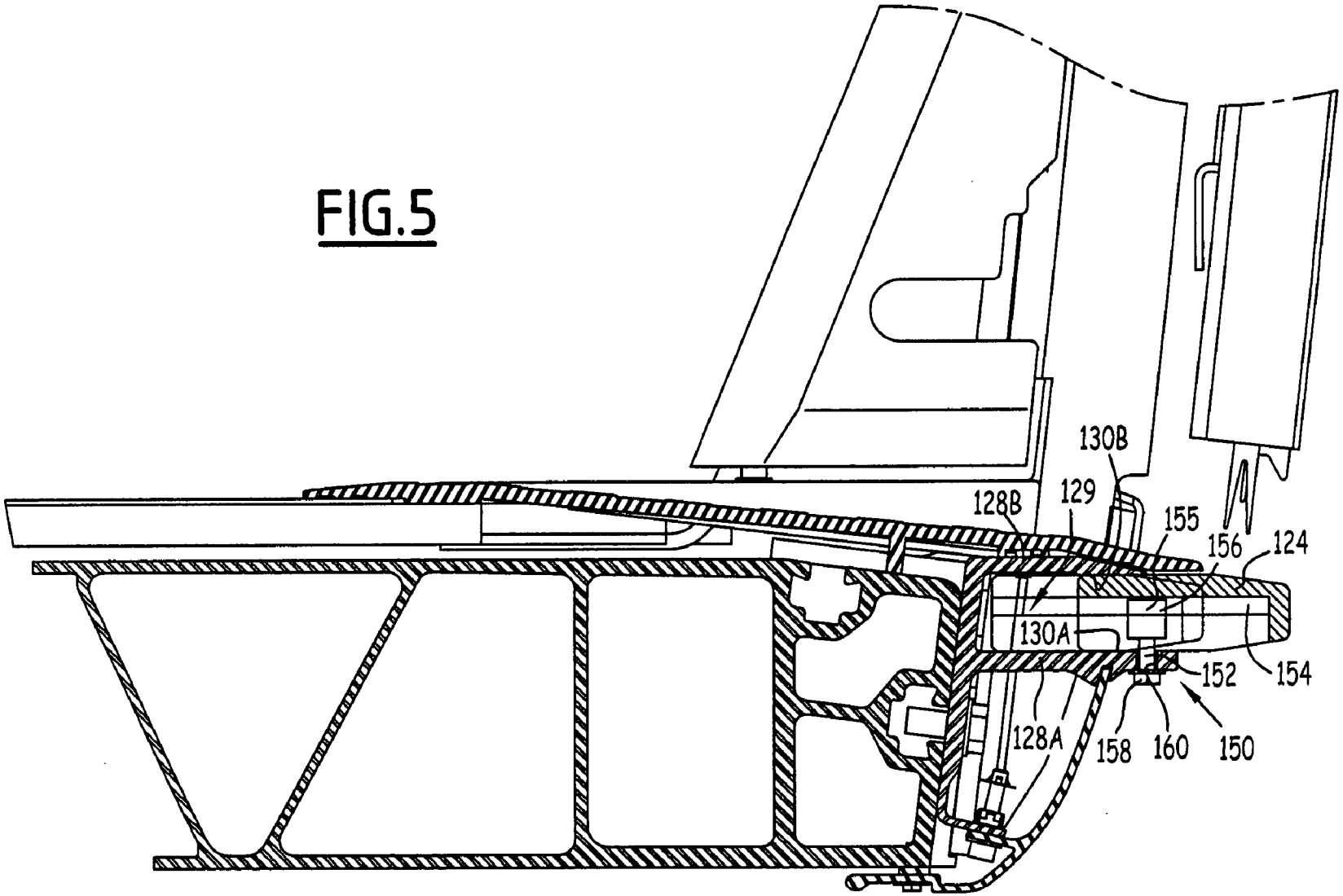
FIGS. 5 and 6 are cross-sections of the lower portion of the railway vehicle showing the threshold of FIG. 4 in a normal projecting position, the sections being taken along lines V—V and VI—VI of FIG. 4, respectively.
Figure 6:
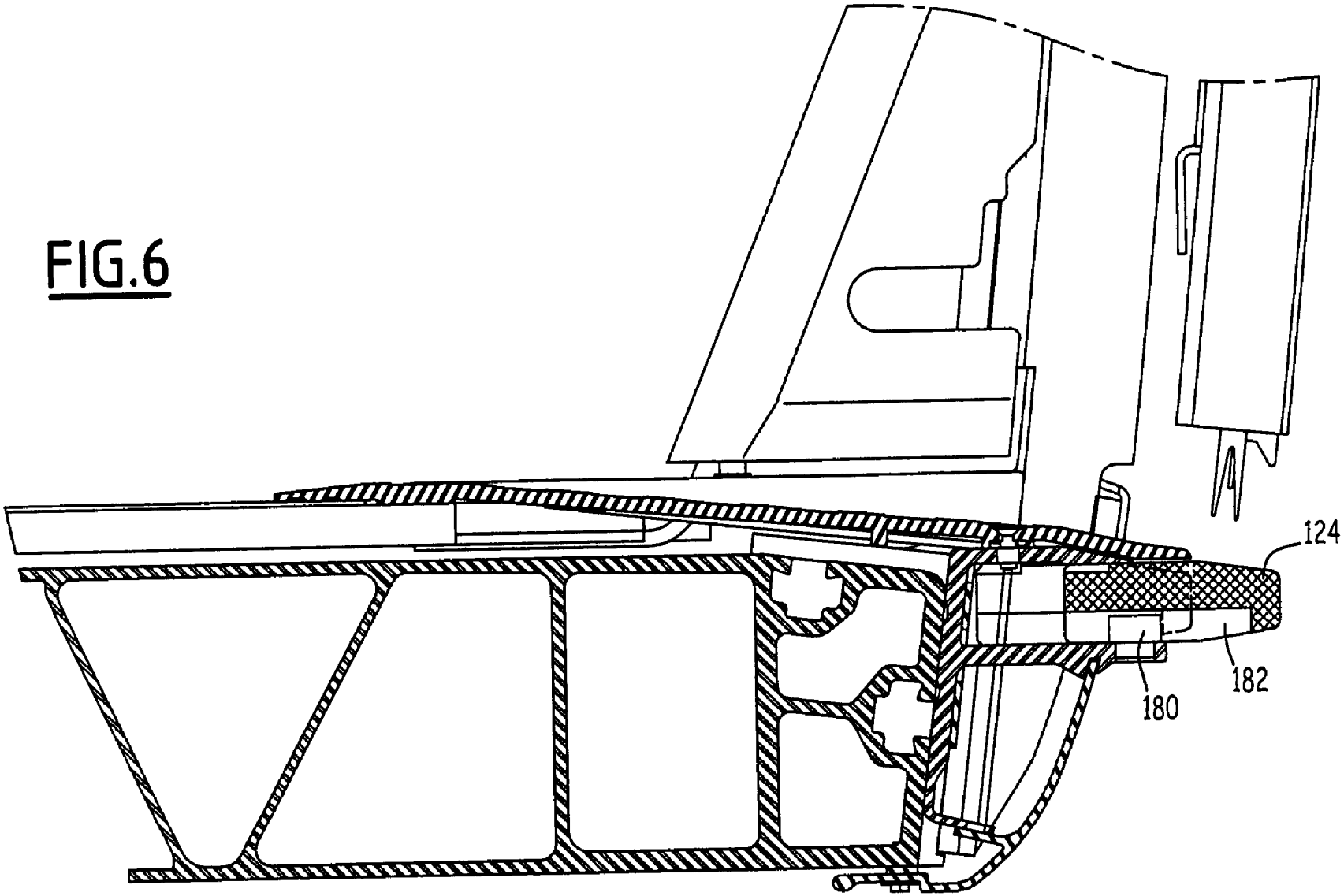

FIGS. 4 to 6 illustrate a second embodiment of a threshold according to the invention.

In this embodiment, elements which are identical or similar to those of the embodiment of FIGS. 1 to 3 are indicated with the same reference numerals, to which 100 has been added.

In this manner, the threshold has, as above, a strip 124 which is engaged in a cap 129 visible in FIG. 5. However, the strip 124 is not retained by a press-fit between the two arms 128A, 128B of the cap.

Conversely, in this embodiment, other means 150 for clamping the strip 124 against the lower clamping surface 130A of the arm 128A are provided, the strip being disengaged but near the surface 130B of the arm 128B, this surface 130B no longer forming a clamping surface.

The clamping means 150 comprise a tie rod 152 which is fixedly joined to the arm 128A and which is engaged in a T-shaped slot 154 which is formed in the strip. This T-shaped slot 154 extends in the direction of movement of the strip. Advantageously, three or four tie rods 152, each associated with a slot, are distributed over the length of the strip.

Each tie rod 152 comprises a strip 155 which has a widened head 156 comprising at least a lateral flat surface, in which a clamping screw 158 is engaged and extends through a hole 160 which is provided in the arm 128A. The head of the screw 158 presses on the outer surface of the arm 128A.

The head 156 of the strip has two lateral lugs which are supported on the surfaces provided in the T-shaped slot 154 and which extend parallel with the clamping surface 130A.

Advantageously, in order to assemble the strip 155, the T-shaped slot 154 opens at a free end arranged at the side orientated in the direction of withdrawal of the strip. Conversely, the T-shaped slot 154 is closed at the projecting end of the strip.

As illustrated in FIGS. 4 and 6, the threshold further comprises a stop for longitudinally arresting the strip. This stop comprises a pin 180 which is integrally formed with the support and, more precisely, with the arm 128A of the cap. This pin is, for example, screwed to the arm 128A and protrudes into the cap. The pin has shear resistance greater than that of the tie rod 152.

The pin is received in a slot 182 whose width is very slightly greater than that of the tie rod. This slot extends in the direction of movement of the strip.

In this embodiment, the retention of the strip 124, in the normal projecting position thereof, is brought about by tightening the screws 158 which keep the strip 124 clamped against the single clamping surface 130A in such a manner as to establish a friction force between the strip and the support. The friction force produced in this manner depends on the tightening of the screws 158, which brings about a traction force via the tie rod 152. In this manner, it is possible for the strip to be retracted only by a specific effort being applied to the strip.

In order to reposition the strip, after retraction, the screws 158 are loosened and the strip is repositioned, after which the screws are retightened to a specific torque bringing about satisfactory retention of the strip.

In this embodiment, the strip can also be readily put in good order after retraction without it being necessary to change the fixing means.

Furthermore, the presence of the stops 180 prevents longitudinal displacement of the strip, even in the event of a very large axial effort which could have resulted in the shearing of the tie rods 152.

The invention claimed is:

1. Door threshold for a railway vehicle, which threshold is intended to partially fill the gap between the vehicle and a platform, comprising a support which can be connected to the structure of the railway vehicle and a strip which is retained by the support, which strip can be displaced between a normal position, in which it projects relative to the support, and a position retracted in the support, wherein said threshold further comprises means for clamping the strip against at least a clamping surface of the support and for producing friction of a specific value between the strip and the support counter to the displacement of the strip relative to the support in the plane of the or each clamping surface, and wherein the clamping means is the only means for retaining the strip.

2. Door threshold according to claim 1, wherein the strip and the support comprise means for guiding the strip from the normal projecting position into the retracted position thereof, which means are provided at the ends of the strip.

3. Door threshold according to claim 1, wherein the strip is formed from a polymer material.

4. Door threshold according to claim 1, wherein the strip has at least a hooking profile for a traction tool allowing displacement of the strip from the retracted position to the normal projecting position thereof.

5. Door threshold according to claim 1 and further comprising at least a stop for longitudinally arresting the strip, which stop is fixedly joined to one of the strip or the support and is received so as to slide in a slot which is provided in the other of the strip or the support, which slot extends in the direction of movement of the strip.

6. Door threshold according to claim 1, wherein the support delimits a cap for retaining the strip, which cap has two facing clamping surfaces, between which the strip is retained by a press-fit.

7. Door threshold according to claim 6, wherein the support comprises a metal profile-section having two arms, each of which has a clamping surface and delimits the cap for retaining the strip, the two arms being connected in the profile-section by a web, with which they are integrally formed.

8. Door threshold according to claim 6, wherein the cap delimits a free space for receiving the strip in the retracted position thereof.

9. Door threshold according to claim 7, wherein the cap delimits a free space for receiving the strip in the retracted position thereof.

10. Door threshold according to claim 1, wherein the clamping means comprises at least a tie rod which is fixedly joined to a first of the strip or the support, which tie rod is arranged so as to slide relative to the second of the strip or the support and is supported on the second of the strip or the support, the tie rod applying a force for clamping the strip against the clamping surface of the support.

11. Door threshold according to claim 10, wherein the tie rod comprises a clamping screw which can adjust the clamping force applied by the tie rod.

12. Door threshold according to claim 10, wherein one of the strip or the support comprises a T-shaped slot which is provided over the thickness thereof and in that the tie rod comprises a strip which is received in the slot.

13. Door threshold according to claim 11, wherein one of the strip or the support comprises a T-shaped slot which is provided over the thickness thereof and in that the tie rod comprises a strip which is received in the slot.

14. Door threshold according to claim 10, wherein the T-shaped slot is provided in the strip and opens at an end which is arranged at the side directed towards the retracted position of the strip.

15. Door threshold according to claim 11, wherein the T-shaped slot is provided in the strip and opens at an end which is arranged at the side directed towards the retracted position of the strip.

* * * * *